US009669512B2

(12) United States Patent
Bajaj et al.

(10) Patent No.: US 9,669,512 B2
(45) Date of Patent: Jun. 6, 2017

(54) CMP PADS HAVING MATERIAL COMPOSITION THAT FACILITATES CONTROLLED CONDITIONING

(71) Applicant: Applied Materials, Inc., Santa Clara, CA (US)

(72) Inventors: Rajeev Bajaj, Fremont, CA (US); Craig E. Bohn, San Jose, CA (US); Fred Conrad Redeker, Fremont, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 0 days.

(21) Appl. No.: 14/454,785

(22) Filed: Aug. 8, 2014

(65) Prior Publication Data

US 2015/0044951 A1 Feb. 12, 2015

Related U.S. Application Data

(60) Provisional application No. 61/864,524, filed on Aug. 10, 2013.

(51) Int. Cl.
*B24B 37/24* (2012.01)
*B24B 53/017* (2012.01)

(52) U.S. Cl.
CPC ..... *B24B 37/245* (2013.01)

(58) Field of Classification Search
CPC ..... B24B 37/245; B24B 37/24; B24B 37/26; B24B 53/017
See application file for complete search history.

(56) References Cited

U.S. PATENT DOCUMENTS 5,197,999 A * 3/1993 Thomas ..... B24B 37/24 51/298
5,578,362 A * 11/1996 Reinhardt ..... B24B 37/26 257/E21.219
6,409,586 B2 * 6/2002 Walker ..... 451/527
6,413,153 B1 * 7/2002 Molar ..... B24B 37/24 451/259

(Continued)

OTHER PUBLICATIONS

PCT Notification of Transmittal of the International Search Report and the Written Opinion of the International Searching Authority for International Application No. PCT/US2014/048902 dated Nov. 12, 2014; 11 total pages.

*Primary Examiner* — Dung Van Nguyen
(74) *Attorney, Agent, or Firm* — Patterson + Sheridan, LLP

(57) ABSTRACT

Embodiments of the disclosure generally provides a method and apparatus for a polishing article or polishing pad having a microstructure that facilitates uniform conditioning when exposed to laser energy. In one embodiment, a polishing pad comprising a combination of a first material and a second material is provided, and the first material is more reactive to laser energy than the second material. In another embodiment, a method of texturing a composite polishing pad is provided. The method includes directing a laser energy source onto a surface of the polishing pad to affect a greater ablation rate within a first material having a greater laser absorption rate and a lesser ablation rate within a second material having a lesser laser absorption rate to provide a micro-textured surface consistent with microstructure of the composite polishing pad.

26 Claims, 6 Drawing Sheets

(56) References Cited

U.S. PATENT DOCUMENTS

| | | | | |
|---|---|---|---|---|
| 6,685,540 | B2 * | 2/2004 | Cherian | B24D 3/32 451/41 |
| 7,579,071 | B2 * | 8/2009 | Huh | B24B 37/205 428/143 |
| 2002/0098789 | A1 | 7/2002 | Burke | |
| 2002/0173231 | A1 * | 11/2002 | Hasegawa | B24B 37/013 451/6 |
| 2006/0154579 | A1 * | 7/2006 | Marks | B24B 37/24 451/285 |
| 2008/0248734 | A1 | 10/2008 | Bajaj | |
| 2009/0270019 | A1 | 10/2009 | Bajaj | |
| 2010/0087128 | A1 * | 4/2010 | Nakayama | B24B 37/24 451/548 |
| 2012/0178349 | A1 | 7/2012 | Kim | |
| 2012/0184194 | A1 | 7/2012 | Kim | |

* cited by examiner

CMP PADS HAVING MATERIAL COMPOSITION THAT FACILITATES CONTROLLED CONDITIONING

CROSS-REFERENCE TO RELATED APPLICATIONS

This application claims benefit of U.S. Provisional Patent Application Ser. No. 61/864,524, filed Aug. 10, 2013, which is incorporated by reference herein.

BACKGROUND

Field

Embodiments disclosed herein generally relate to the manufacture of polishing articles utilized in chemical mechanical polishing (CMP) processes. More specifically, embodiments disclosed herein are related to compositions of materials and methods of manufacturing polishing articles.

Description of the Related Art

Chemical-mechanical polishing (CMP), also known as chemical mechanical planarization, is a process used in the semiconductor fabrication industry to provide flat surfaces on integrated circuits devices. CMP involves pressing a rotating wafer against a rotating polishing pad, while applying polishing fluid or slurry to the pad to affect removal of films or other materials from a substrate. Such polishing is often used to planarize insulating layers, such as silicon oxide and/or metal layers, such as tungsten, aluminum, or copper, that have been previously deposited on the substrate.

The polishing process results in "glazing" or smoothening of the pad surface, which reduces film removal rate. The surface of the polishing pad is "roughened" or conditioned to restore the pad surface which enhances local fluid transport and improves removal rate. Typically, conditioning is performed, in between polishing two wafers or in parallel with polishing the wafer, with a conditioning disk coated with abrasives such as micron sized industrial diamonds. The conditioning disk is rotated and pressed against the pad surface and mechanically cuts the surface of the polishing pad. However, while the rotation and/or down force applied to the conditioning disk is controlled, the cutting action is relatively indiscriminate, and the abrasives may not cut into the polishing surface evenly, which creates a differential in surface roughness across the polishing surface of the polishing pad. As the cutting action of the conditioning disk is not readily controlled, the pad lifetime may be shortened. Further, the cutting action of the conditioning disk sometimes produces large asperities in the polishing surface, along with pad debris. While the asperities are beneficial in the polishing process, the asperities may break loose during polishing, which creates debris that, along with pad debris from cutting action, contributes to defects in the substrate.

Numerous other methods and systems that act on the polishing surface of the polishing pad have been performed in an attempt to provide uniform conditioning of the polishing surface. However, control of the devices and systems (e.g., cutting action, down force, among other metrics) remain unsatisfactory and may be frustrated by the properties of the polishing pad itself. For example, properties such hardness and/or density of the pad material may be non-uniform, which leads to more aggressive conditioning on some portions of the polishing surface relative to other portions.

Therefore, there is a need for a polishing article having properties that facilitate uniform polishing and conditioning.

SUMMARY

Embodiments of the disclosure generally provide a method and apparatus for a polishing article or polishing pad having a microstructure that facilitates uniform conditioning when exposed to laser energy. In one embodiment, a polishing pad comprising a combination of a first material and a second material is provided, and the first material is more reactive to laser energy than the second material.

In another embodiment, a polishing pad is provided. The polishing pad includes a body comprising a combination of a first material and a second material, the second material comprising a metal oxide dispersed in the first material, wherein the first material is more reactive to laser energy than the second material.

In another embodiment, a polishing pad is provided. The polishing pad includes a polishing pad comprising a combination of two or more immiscible materials comprising a first material, a second material, and a third material, wherein the first material is more absorbent to a 355 nanometer wavelength laser than the second material, and the third material is less absorbent of the 355 nanometer wavelength laser than the second material.

In another embodiment, a polishing pad is provided. The polishing pad includes a body comprising a first polymer material and a second polymer material, the first polymer material being uniformly dispersed within the second polymer material, and a third material comprising a plurality of particles dispersed in one or both of the first material and the second material, wherein the first material is more reactive to laser energy than the second material.

In another embodiment, a method of texturing a composite polishing pad is provided. The method includes directing laser energy source onto the surface of the polishing pad to affect a greater ablation rate within a first material having a greater laser absorption rate and a lesser ablation rate within a second material having a lesser laser energy absorption rate to provide a micro-textured surface consistent with microstructure of the composite polishing pad.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, common words have been used, where possible, to designate identical elements that are common to the figures. It is contemplated that elements disclosed in one embodiment may be beneficially utilized on other embodiments without specific recitation.

DETAILED DESCRIPTION

The present disclosure relates to polishing articles and methods of manufacture thereof, as well as methods of polishing substrates and conditioning of the polishing articles before, during and after polishing of substrates.

Figure 1A:
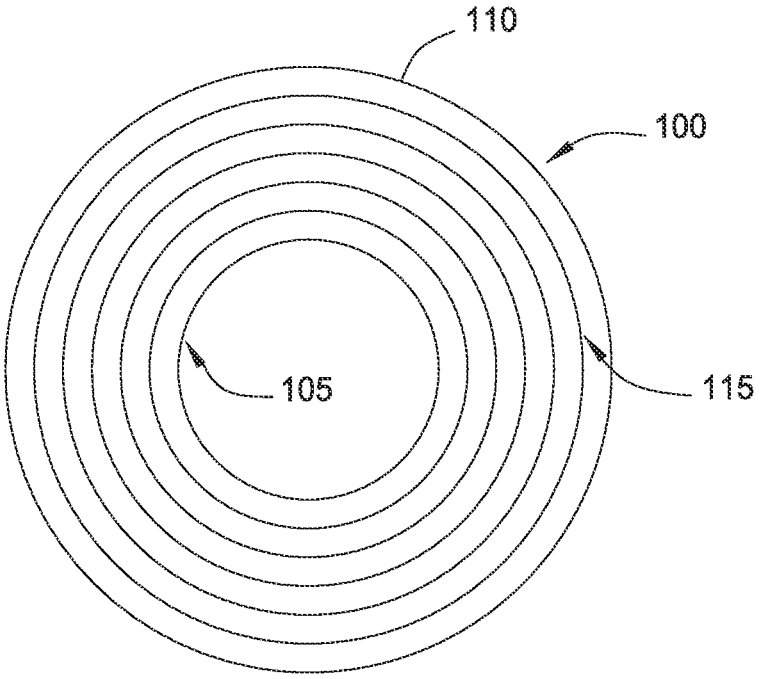
FIG. 1A is a top plan view of one embodiment of a polishing article having a groove pattern formed in a polishing surface.

FIG. 1A is a top plan view of a polishing article 100 having a groove pattern 105 formed in a polishing surface 110. The groove pattern 105 includes a plurality of grooves 115. In the embodiment shown, the groove pattern 105 includes concentric circles, but the pattern 105 may include linear or non-linear grooves. The groove pattern 105 may also include radially oriented grooves.

Figure 1B:
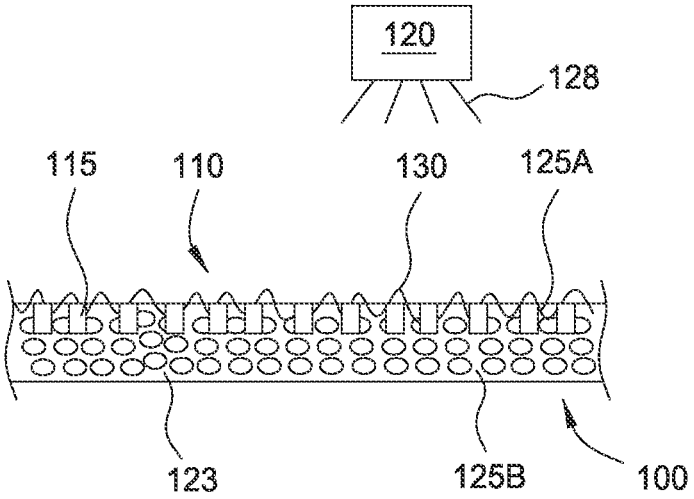
FIG. 1B is a schematic side cross-sectional view of the polishing article shown in FIG. 1A.

FIG. 1B is a schematic side cross-sectional view of the polishing article 100 shown in FIG. 1A. The polishing article 100 includes a body 123 comprising a first material 125A and a second material 125B. The groove pattern 105 may be formed when the polishing article 100 is manufactured or the groove pattern 105 may be formed by removal of the second material 125B disposed within the first material 125A via exposure of the body 123 to a laser energy source 120. The groove pattern 105 may be formed of the second material 125B disposed within the first material 125A, and the second material 125B is reactive with the energy from the laser energy source 120 while the non-grooved remainder of the polishing surface 110 consisting of the first material 125A is substantially non-reactive with the energy from the laser energy source 120. The groove pattern 105 may be formed using a beam 128 or a broader flood of laser energy for a specified time and/or specified output power to remove the second material 125B at a removal rate that corresponds to a desired depth for the grooves 115. In one embodiment, the groove pattern 105 formed on the polishing surface 110 comprises a textured surface 130.

Figure 2A:
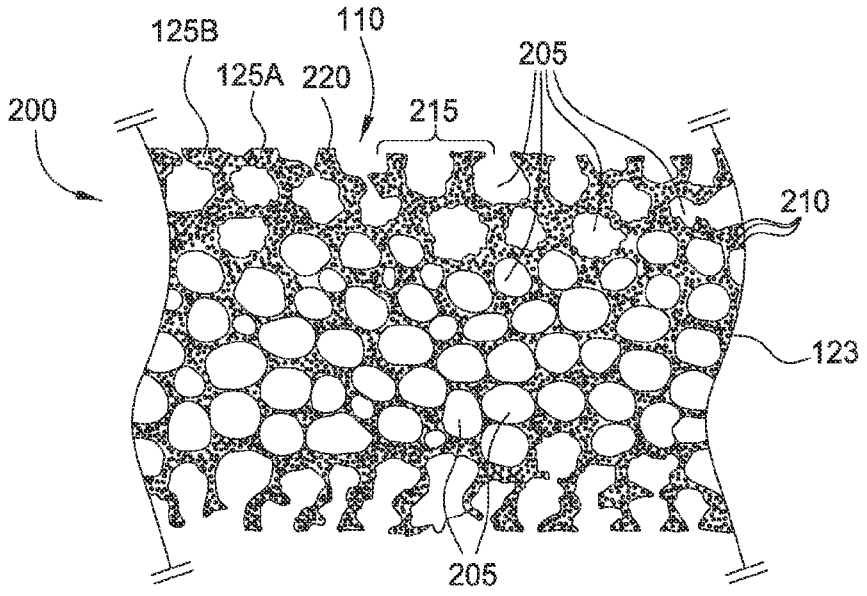
FIGS. 2A and 2B are enlarged cross sectional views of a portion of an alternate embodiment of a polishing article.
Figure 2B:
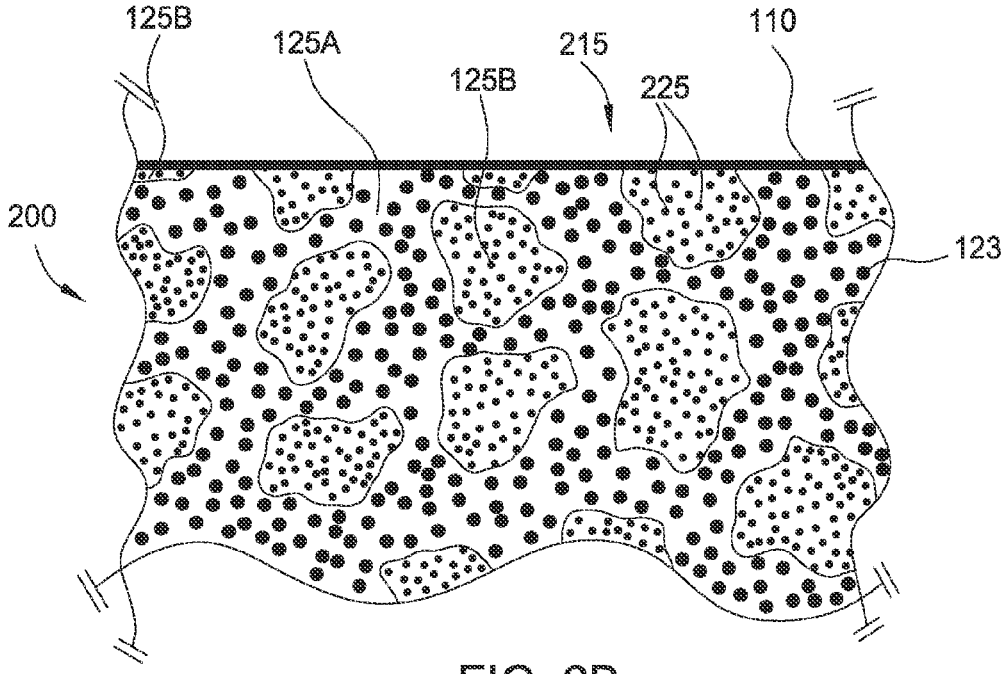

FIGS. 2A and 2B are enlarged cross sectional views of a portion of an alternate embodiment of a polishing article 200. The polishing surface 110 of the polishing article 200 may include a microscopic pore structure (e.g., a plurality of pores 205 having a size of about 1.0 micron, or less, to about 50 microns). The microscopic pore structure may be provided during manufacture of the polishing article. The pores 205 may be formed by adding micro-structures 210 of desired size into the pad forming mixture. The micro-structures 210 may be balloon-like structures or material. Alternatively or additionally, the micro-structures 210 may be formed by injecting gas into the pad forming mixture.

The polishing surface 110 of the polishing article 200 may also include a texture 215, which may include an embossing pattern and/or a plurality of nap-like structures 220. The texture 215 may be formed by second materials 125B distributed within the first material 125A and by exposing the body 123 to the laser energy source 120 (shown in FIG. 1B) in order to selectively alter the second materials 125B. As shown in FIG. 2B, the pores 205 shown in FIG. 2A may be formed in one or more regions of the second material 125B when exposing the body 123 to laser energy. Alternatively, the texture 215 may be formed by selectively exposing regions of the polishing surface 110 to laser energy and not exposing other regions of the polishing surface 110, such as by using a mask. The texture 215 may be formed when the polishing article 200 is manufactured or the texture 215 may be formed during a conditioning process using the laser energy source 120.

The texture 215 on the polishing surface 110 may be formed from a composite material (i.e., the first material 125A and the second material 125B) contained in the body 123 of the polishing article 100 by exposure to the laser energy source 120. In one embodiment, the body 123 of the polishing article 100 includes a polymer composite material including polymer nano-domains uniformly dispersed therein. The size of the nano-domains may be about 10 nanometers to about 200 nanometers. The nano-domains may comprise a single polymer material, a metal oxide abrasive, a combination of polymer materials, a combination of metal oxides or a combination of polymer materials and metal oxides. The texture 215 may be formed from the composite material included in the body 123 of the polishing article 100 by exposure to the laser energy source 120. The metal oxide may comprise silica, alumina, ceria, silicon carbide, or a combination thereof.

In one embodiment, the polishing article 100 comprises a polymeric base material as the first material 125A and a plurality of microelements are included in the polymeric base material as a second material 125B. In one aspect, the microelements as the second material 125B includes particles comprising micron sized or nano sized materials (i.e., particles 225) interspersed in the polymeric base material as the first material 125A. In some embodiments, the first material 125A may be a mixture of polymer materials having different reactivity or absorption rates with respect to the laser energy from the laser energy source 120. Suitable polymeric materials for the microelements that may be used include polyurethane, a polycarbonate, fluoropolymers, PTFE, PTFA, polyphenylene sulfide (PPS), or combinations thereof. Examples of such polymeric microelements also include polyvinyl alcohols, pectin, polyvinyl pyrrolidone, hydroxyethylcellulose, methylcellulose, hydropropylmethylcellulose, carboxymethylcellulose, hydroxypropylcellulose, polyacrylic acids, polyacrylamides, polyethylene glycols, polyhydroxyetheracrylites, starches, maleic acid copolymers, polyethylene oxide, polyurethanes and combinations thereof.

In one embodiment, the polymeric base material comprises open-pored or closed-pored polyurethane material, and each of the particles are nano-scale particles interspersed in the polymeric base material. The particles may include organic nanoparticles. In one embodiment, the nanoparticles may include molecular or elemental rings and/or nanostructures. Examples include allotropes of carbon (C), such as carbon nanotubes and other structures, molecular carbon rings having 5 bonds (pentagonal), 6 bonds (hexagonal), or more than 6 bonds. Other examples include fullerene-like supramolecules. In another embodiment, the nano-scale particles may be a ceramic material, alumina, glass (e.g., silicon dioxide ($SiO_2$)), and combinations or derivatives thereof. In another embodiment, the nano-scale particles may include metal oxides, such as titanium (IV) oxide or titanium dioxide ($TiO_2$), zirconium (IV) oxide or zirconium dioxide ($ZrO_2$), combinations thereof and derivatives thereof, among other oxides.

The polishing article 100 may comprise a composite base material, such as a polymeric matrix which may be formed from urethanes, melamines, polyesters, polysulfones, polyvinyl acetates, fluorinated hydrocarbons, and the like, and mixtures, copolymers and grafts thereof. In one embodiment, the polymeric matrix comprises a urethane polymer that may be formed from a polyether-based liquid urethane. The liquid urethane may be reactive with a polyfunctional amine, diamine, triamine or polyfunctional hydroxyl compound or mixed functionality compounds, such as hydroxyl/amines in urethane/urea cross-linked compositions that form urea links and a cross-linked polymer network when cured.

The polymer matrix as the first material 125A that may be mixed with a plurality of microelements as the second material 125B. The microelements may be a polymeric material, a metallic material, a ceramic material, or combinations thereof. The microelements may be micron sized or nano sized materials that form micron sized or nano sized domains within the polishing surface 110 of the polishing article 100. Each of the microelements may include a mean diameter which is less than about 150 microns to about 10 microns, or less. The mean diameter of at least a portion of the nano sized materials (i.e., particles) may be about 10 nanometers, although a diameter greater than or less than 10 nanometers may be used. The mean diameter of the microelements may be substantially the same or may be varied, having different sizes or mixtures of different sizes, and may be impregnated in the polymeric matrix, as desired. Each of the microelements may be spaced apart at a mean distance of about 0.1 micron to about 100 microns. The microelements may be substantially uniformly distributed throughout the polymeric base material.

In one embodiment, the microelements are uniformly dispersed or distributed within the polymeric base material. "Uniformly dispersed" or "uniformly distributed" may be defined as weight percent (wt %) and number of particles per unit volume in any section varies by less than 10% from the average number of particles and wt % for the whole polishing article 100.

The laser energy source 120 comprises a laser beam (or beams) that ablates one of the first material 125A and the second material 125B in preference to the other. The ablation may occur due to energy absorption by specific functional groups or bonds, which results in breakage of polymer chains. The smaller chains can further break into volatilized fragments which may be carried away from the polishing surface in a fluid that may be utilized during formation and/or use of the polishing surface 110. Since laser energy is specific, and is absorbed by different materials to different degrees, these composite materials, with varying degrees of laser energy absorption, can be utilized to generate textures by selective ablation of one material over the other. For example, a composite material with nano-sized domains of less absorbing material in a matrix of more absorbing material would cause laser conditioning to expose or relief-etch the matrix such that nano-sized domains are exposed and can be used to affect substrate polishing. In one embodiment, when a polishing pad with a polymer matrix consisting of dispersed abrasive nano-particles is subjected to 355 nm laser, the binder polymer is ablated in preference to the abrasive particles, creating a micro-texture having a plurality of abrasive particles exposed. The abrasive particles may be beneficially utilized to remove material from a substrate in a polishing process using the polishing pad.

Figure 3:
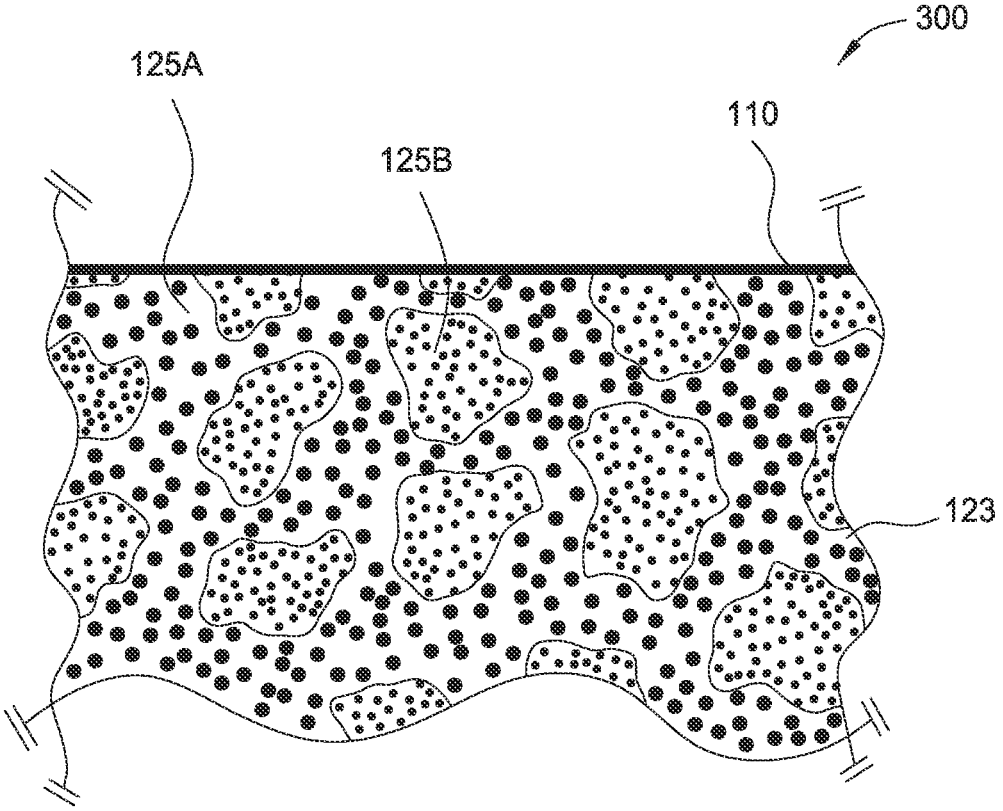
FIG. 3 is a partial side cross-sectional view of another embodiment of a polishing article.

FIG. 3 is a partial side cross-sectional view of an alternate embodiment of a polishing article 300. The polishing article 300 is comprised of a first material 125A and a second material 125B. The second material 125B is more reactive to laser energy than the first material 125A. The first and second materials may be uniformly mixed, which may be accomplished by such methods as sheer mixing forces, or the first and second materials may include properties that manifest in a blended compound including the multiple materials. Alternatively, the first and second materials may be controllably combined, precisely positioning the first material 125A with respect to the second material 125B. Such precise placement may be accomplished by such methods as controlled extrusion or 3-dimensional material printing.

Figure 4:
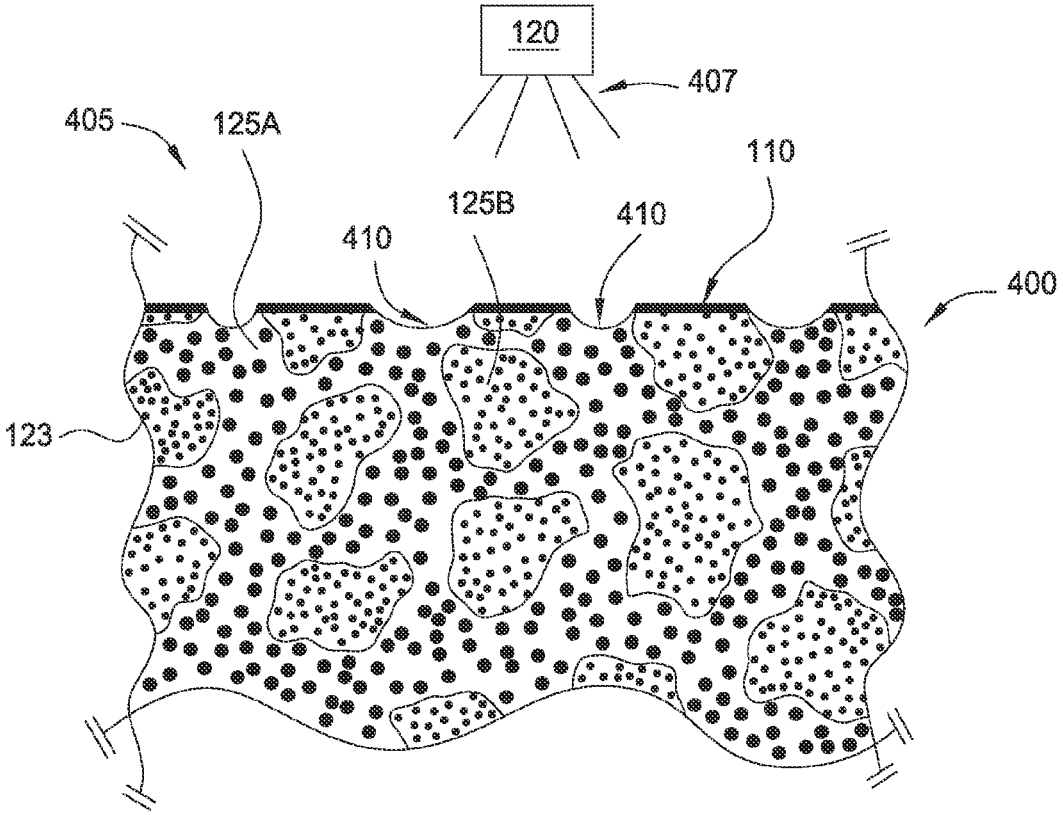
FIG. 4 is a partial side cross-sectional view of an alternate embodiment of a polishing article.

FIG. 4 is a partial side cross-sectional view of an alternate embodiment of a polishing article 400. The polishing article 400 may be comprised of a first material 125A and a second material 125B, wherein the first material 125A is more reactive to laser energy than the second material 125B. As discussed above, the materials may be uniformly mixed, which may be accomplished by such methods as sheer mixing forces or material properties that manifest in a blended compound of the multiple materials or alternatively, the materials may be controllably combined, precisely positioning the first material 125A with respect to the second material 125B, such as by controlled extrusion or 3-dimensional material printing.

In one embodiment, the polishing surface 110 of the polishing article 400 is micro-textured by exposing the polishing surface 110 to precisely controlled and focused laser energy 407 from the laser energy source 120. Laser energy 407 preferentially removes the first material 125A relative to the second material 125B thus creating an ablated void 410. The second material 125B extends above and/or around the ablated void 410 formed in the first material 125A, and the remaining first material 125A and the second material 125B defines the polishing surface 110.

Laser energy 407 may be precisely focused on the polishing surface 110 to affect a greater ablation rate within the first material 125A, which has a greater laser absorption rate and a lesser ablation rate as compared to the second material 125B, which has a lesser laser energy absorption rate as compared to the first material 125A. The greater ablation rate of the first material 125A creates the ablated voids 410 in order to provide a micro-textured surface 415. The polishing article 400 shown in FIG. 4 may comprise a portion of a polishing pad 405 that may be used in a substrate polishing process. The micro-textured surface 415 may be consistent with the chosen operating parameters of the laser energy source 120, and/or the microstructure of the polishing pad 405.

An exemplary patterning method includes directing focused laser energy 407 from the laser energy source 120 onto the polishing surface 110 of the polishing pad 405. The focused laser energy 407 is absorbed to a greater degree by portions of the polishing surface comprised of the first material 125A, and material is removed from the areas of the first material 125A. In one embodiment, the material removal is controllable by the laser intensity, the laser focus, and the duration of the laser energy. By controlling the laser energy delivered to the first material 125A, the characteristics of ablated voids 410 may be controlled. The size of the ablated voids 410 (e.g., length/width, diameter (or other dimension) as well as depth) may be controlled by controlling the application of laser energy 407 to the polishing surface 110. For example, a precise beam or beams of specific beam intensity, diameter and duration may produce micro-sized voids in the polishing surface 110 while a beam or beams having a different beam intensity, diameter and duration may produce larger sized voids. Thus, controlling the delivery of the laser energy 407 provides controllable, selective creation of ablated voids 410 of a desired depth, width and shape in the polishing surface 110 of the polishing pad 405. The creation of the ablated voids 410 may be repeated as necessary to provide a desired pattern on the polishing surface 110. The micro-textured surface 415 may be formed during manufacture of the polishing pad 405, and/or recreated before, during, or after use in a substrate polishing process. The laser power and operating conditions are provided such that about 1 micron to about 20 microns of pad material is removed from the polishing surface 110 in a single pass of a laser beam. Typically, during a polishing process, less than about 0.5% of pad surface area is textured (during conditioning) before, during or after processing a substrate.

Figure 5:
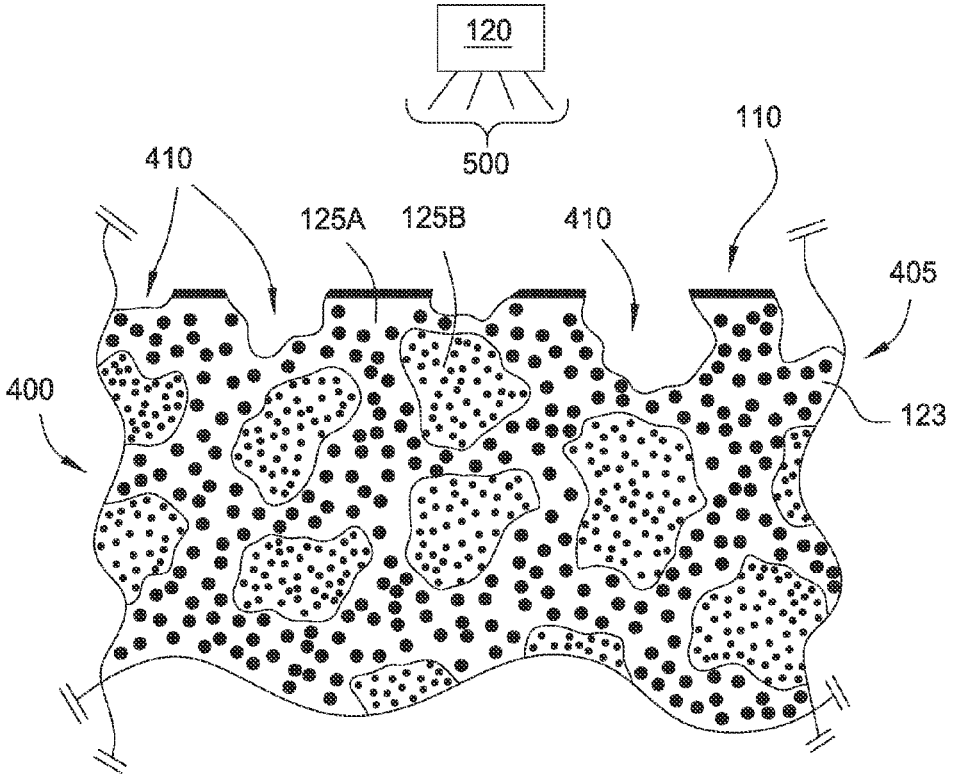
FIG. 5 is a partial side cross-sectional view of the polishing article in FIG. 4 processed in a manner according to one embodiment.

FIG. 5 is a partial side cross-sectional view of the polishing article 400 shown in FIG. 4, processed in an alternate manner according to the embodiments. In this embodiment, the second material 125B has a lesser laser absorption rate as well as a greater ablation rate as compared to the first material 125A, which has a greater laser energy absorption rate when compared to the second material 125B. The polishing surface 110 of the polishing pad 405 is micro-textured by exposing the polishing surface 110 to a broad dose or flood of laser energy 500. Laser energy 500 is directed to the polishing surface 110 to affect a greater ablation rate of the second material 125B as compared to the first material 125A. The greater ablation rate creates ablated voids 410, to provide a micro-textured surface that may be consistent with the microstructure of the composite polishing pad 405 (i.e., the ratio and/or density of the first material 125A relative to the second material 125B in the polishing pad 405). In some embodiments, particularly during pad conditioning, the power level, dwell time, and other attributes of the laser energy, is provided such that neither of the first material 125A and the second material 125B are completely ablated. In one embodiment, in order to refresh the polishing surface 110 and provide a texture thereto, less than about 0.05% of the pad surface is removed (from each of the domains of the first material 125A and the second material 125B). Thus, while the polishing surface 110 is refreshed, which enhances removal of material from a substrate, the lifetime of the polishing pad 405 may be extended since material removal is limited to only a portion of the polishing surface 110.

The exemplary method includes directing laser energy 500 from the laser energy source 120 onto the polishing surface 110 of the polishing pad 405. The laser energy is absorbed to a greater degree by portions of the polishing surface comprised of the second material, and material is removed from the areas of the second material. By controlling the energy delivered to the second material, the characteristics of the ablated void may be controlled. Controlling the energy delivery permits controllable, selective creation of ablated voids without damaging the surrounding first material.

Figure 6:
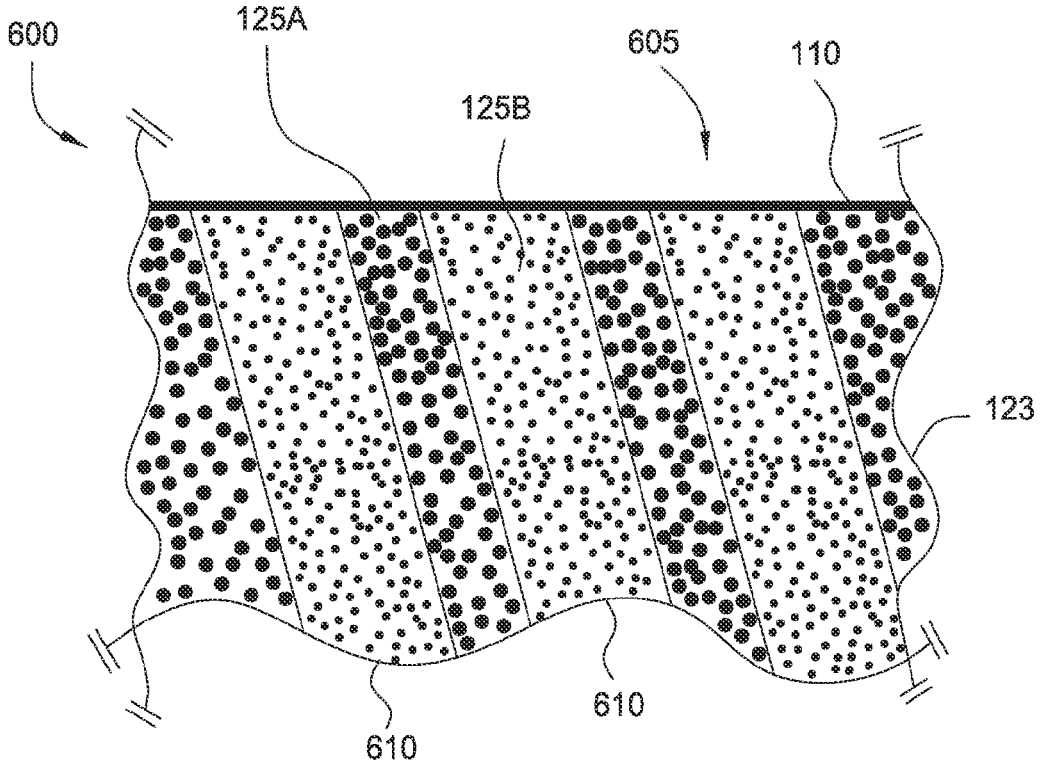
FIG. 6 is a side cross-sectional view of a portion of another embodiment of a polishing article.

FIG. 6 is a side cross-sectional view of a portion of another embodiment of a polishing article 600 according to the present disclosure. The polishing article 600 may comprise a polishing pad 605 that is comprised of a first material 125A and a second material 125B, wherein one of the first material 125A or the second material 125B is more reactive to laser energy than the other material. The first material 125A and the second material 125B may be controllably combined, precisely positioning the first material 125A with respect to the second material 125B. Such precise placement may be accomplished by such methods as controlled extrusion or 3-dimensional material printing. Although not shown in FIG. 6, the material which is more reactive to laser energy than the other material may be laser ablated to form voids in the surface, such as shown in FIGS. 4 and 5.

In some embodiments, discreet regions of the second material 125B, which may be discreet non-contiguous regions or interconnected regions, may be precisely oriented within the first material. For example, the embodiment depicted in FIG. 6, the discreet regions of the second material 125B may be in the form of columns 610 extending from the polishing surface 110 through the body 123 of the polishing pad 605 to the bottom surface of the polishing article 600. The columns 610 may comprise pillars that are perpendicular to a plane of the polishing surface 110, or inclined relative to the plane of the polishing surface 110 as shown in FIG. 6. The columns 610 may be linear, zigzagged, wavy or spiral. In other embodiments, the columns 610 may be in the form of concentric cylinders or concentric truncated cones.

The polishing articles 100, 200, 300, 400 and 600 shown in FIGS. 1A-6 may be formed by numerous methods including 3 dimensional (3D) printing or an injection molding process. In the 3D printing method, the desired polymers and/or microelement materials may be sprayed, dropped or otherwise deposited by the printer to form layers on a platen to form the polishing article based on a digitized design. The deposited polymeric materials to form a single polishing article. Each material may be discretely deposited by the printer to form a matrix having a predefined distribution of at least one material to at least another material. The predefined distribution may be a uniform distribution of the materials, and may include depositing at least a first material in geometric shapes. The geometric shapes may include clusters and/or patterns of the first material in varying geometric shapes within a bulk deposition of the second material so that after one of the first or second material is selectively removed by the laser energy, the resulting asperities have the geometric shape as deposited by the printer. Alternatively, an article may be formed that may be cut into multiple polishing articles comprising similar material properties within a first material and a second material of each of the polishing articles.

In the injection molding method, the microelements may be substantially uniformly distributed throughout the polymeric base material by high shear mixing. In one example, two or more polymers, or one or more polymers and microelements may be mixed separately, prior to injection molding, for example in a "twin screw" extruder to achieve complete mixing. It may also be advantageous to consider copolymers with suitable microstructure that can be beneficially used to make the polishing pads. In this method, a copolymer is made by polymerizing two monomers such that the resulting polymer chains contain both monomers. Depending on the chemical nature of the two monomers, the two types of materials may organize themselves into regions of monomer A rich and monomer B rich phases. An example of such copolymer is ABS (acrylonitrile-butadiene-Styrene), where the polymer matrix is divided into butadiene rich rubbery phase and styrene rich glassy phase. The size and number of rubber domains can be controlled by modulating the amount of acrylonitrile and butadiene. This composition may be advantageous for improved mechanical properties over polystyrene alone and butadiene alone. Similar compositions, which enable different rates of absorption of laser energy maybe generated for laser conditioning, thereby enabling controlled textures for polishing.

In all of the embodiments described above, a third material may be intermixed with at least one of the first and second materials. The third material may be more or less reactive to laser energy than the other materials. In some embodiments, the third material may be highly un-reactive with laser energy as compared to the other materials such that the third material will protrude from surfaces of the ablated material. In some embodiments, the third material is a fixed abrasive material, such as an oxide.

In one embodiment, a polishing article is provided comprising a composite material having different reactivity to and/or absorption of laser energy. The composite material includes at least a first material and a second material interspersed within the first material. The laser energy includes wavelengths that are preferentially reactive with, and/or preferentially absorbed by, one of the materials over the other material. In one embodiment, the laser energy is used to condition the polishing surface of the polishing article. In one aspect, the laser energy is a beam of light that is directed onto the polishing surface of the polishing article. The differential reactivity of the composite material provides selective removal (i.e., ablation) of one material relative to another material during exposure of the composite material to laser energy. In one embodiment, the laser energy comprises laser wavelengths that are used to ablate the reactive material (i.e., the second material) while not reacting or reacting minimally (e.g., a laser energy absorption rate of the reactive material is at least 2 times a laser energy absorption rate of the less reactive material) with the other material (i.e., the first material). The second material may be uniformly dispersed within the first material such that ablation of the second material provides a uniform surface roughness on the polishing surface of the polishing pad. Texture, thus generated, is correlated to the size of dispersed phase and applied laser energy, where the desired average surface roughness (Ra) is in the range of 1-20 microns and reduced peak height (Rpk) is in the range of 1-15 microns. In another embodiment, laser energy is preferentially absorbed by the first material over the second (dispersed phase), thus creating a texture. The polishing article may be utilized to polish semiconductor substrates as well as other substrates used in the manufacture of other devices and articles.

The composite material of the polishing pad may include two or more polymers having different properties, one or more polymers mixed with an abrasive agent, or combinations thereof. The composite material may include the first material and the second material interspersed within the first material, and the first and second materials have different reactivity with laser energy. Other materials (polymers, ceramics and/or metals, including alloys and oxides thereof) may be added to the composite in addition to, or as a replacement of one of the first and second materials. The other materials may have a reactivity with laser energy that is different than the reactivity of one or both of the first and second material.

In one aspect, the polymers are chosen to have properties that provide a different reactivity to laser energy at wavelengths within the ultraviolet (UV) spectrum, the visible spectrum, the infrared (IR) spectrum, among other wavelength ranges. For example, one or more of the materials within the composite material of the polishing article may be reactive with laser energy within one or more of these spectrums while another of the materials within the composite material of the polishing article is substantially non-reactive with the laser energy. The reactivity of select materials within the composite material of the polishing article with the laser energy over other materials within the composite material of the polishing article may be used to create a patterned polishing surface on the polishing pad. In one aspect, the patterned polishing surface may be based on the relative placement of the different materials within the composite material during formation of the polishing article.

In another aspect, the polymers are chosen to have different reactivity with laser energy as compared to the reactivity of an abrasive agent (i.e., abrasive elements). For example, the first material may be a polymer that is reactive with wavelengths within the UV, IR or visible spectrums and the second material may be abrasive elements that are non-reactive with the aforementioned wavelengths. Thus, portions consisting of the first material may be removed in preference to the second material providing a uniform layer of exposed abrasive elements on the polishing surface on the polishing pad.

"Reactive" or "reactivity" as used herein includes the ability of a laser energy source to alter specific materials within the composite material of the polishing article. Alteration includes vaporization, sublimation, changing the surface morphology of the materials, or other changes that would not occur in the absence of the laser energy used to interact with the composite material as described herein. "Reactive" or "reactivity" as used herein also includes the inability of the material to absorb incident laser energy. "Substantially non-reactive" may be defined as the incapability of a laser energy source to cause a substantial alteration of specific materials within the composite material of the polishing article under normal operating conditions (i.e., wavelength range of the laser energy source, output power of the laser energy source, spot size of the laser energy source, dwell time of the laser energy source on the composite material of the polishing article, and combinations thereof). "Substantially non-reactive" may also be defined as the ability of a specific material to be transparent to a wavelength or wavelength range of the laser energy source (i.e., ability of a specific material to absorb incident laser energy).

While the foregoing is directed to embodiments of the present disclosure, other and further embodiments of the disclosure may be devised without departing from the basic scope thereof, and the scope thereof is determined by the claims that follow.

The invention claimed is:

1. A polishing pad, comprising:

a body comprising a combination of a first polymer material, a second polymer material comprising a plurality of nano-domains dispersed in the first polymer material, and a third material comprising a metal oxide, wherein the third material is uniformly dispersed in the first polymer material or the second polymer material, and wherein the first polymer material is more reactive to laser energy than the third material.

2. The polishing pad of claim 1, wherein the first polymer material is more reactive to the laser energy than the second polymer material.

3. The polishing pad of claim 1, wherein the first polymer material or the second polymer material is selected from polyurethane, PMMA, PVA, epoxy, ABS, polyoxymethylene, PPS, polycarbonate, or a combination thereof, and the metal oxide comprises silica, alumina, ceria, silicon carbide, or a combination thereof.

4. The polishing pad of claim 1, wherein the third material further comprises a plurality of particles.

5. The polishing pad of claim 4, wherein each of the plurality of particles comprises silica, alumina, ceria, silicon carbide, or a combination thereof.

6. The polishing pad of claim 1, wherein the first polymer material has a smaller absorption rate than the material within the nano-domains at a wavelength found within the laser energy.

7. The polishing pad of claim 1, wherein the nano-domains are preferentially removed from the body versus the first material when one or more of the nano-domains and the first material are both exposed to the laser energy, wherein the laser energy has a wavelength within the ultraviolet spectrum, visible spectrum or infrared spectrum.

8. A polishing pad, comprising:

a body comprising a first polymer material and a plurality of nano-domains that comprise a second polymer material being uniformly dispersed within the first polymer material, and a third material comprising a plurality of particles dispersed in one or both of the first polymer material and the second polymer material, wherein the first polymer material is more reactive to laser energy than the second polymer material.

9. The polishing pad of claim 8, wherein each of the plurality of particles comprises silica, alumina, ceria, silicon carbide, or a combination thereof.

10. The polishing pad of claim 8, wherein an average size of each of the plurality particles is less than about 100 microns.

11. The polishing pad of claim 8, wherein one or both of the first polymer material and the second polymer material is selected from polyurethane, PMMA, PVA, epoxy, ABS, polyoxymethylene, PPS, polycarbonate, or a combination thereof.

12. The polishing pad of claim 8, wherein one or more grooves are formed in a major surface of the body.

13. The polishing pad of claim 1, wherein the first polymer material is more absorbent to a 355 nanometer wavelength laser than the second polymer material.

14. The polishing pad of claim 8, wherein the first polymer material is more absorbent to a 355 nanometer wavelength laser than the second polymer material.

15. The polishing pad of claim 8, wherein the first polymer material has a larger absorption rate than the second material at a wavelength found within the laser energy.

16. The polishing pad of claim 8, wherein the first material is preferentially removed from the body versus the second material when the first material and the second material are both exposed to the laser energy, wherein the laser energy has a wavelength within the ultraviolet spectrum, visible spectrum or infrared spectrum.

17. A polishing pad, comprising:

a body comprising a combination of a first polymer material, a second polymer material comprising a plurality of nano-domains uniformly dispersed in the first polymer material, and a third material comprising a plurality of particles, wherein the third material is uniformly dispersed in the first polymer material or the second polymer material, and wherein the first polymer material is more reactive to laser energy than the third material and the first material is more reactive to laser energy than the second material.

18. The polishing pad of claim 17, wherein each of the plurality of particles comprises silica, alumina, ceria, silicon carbide, or a combination thereof.

19. The polishing pad of claim 17, wherein an average size of each of the plurality particles is less than about 100 microns.

20. The polishing pad of claim 17, wherein one or both of the first polymer material and the second polymer material is selected from polyurethane, PMMA, PVA, epoxy, ABS, polyoxymethylene, PPS, polycarbonate, or a combination thereof.

21. The polishing pad of claim 17, wherein one or more grooves are formed in a major surface of the body.

22. The polishing pad of claim 17, wherein the first polymer material is more absorbent to a 355 nanometer wavelength laser than the second polymer material.

23. A polishing pad, comprising:

a body comprising a plurality of layers that are sequentially deposited by use of a printer, wherein each of the deposited layers comprise:

a first polymer material; and a plurality of nano-domains that comprise a second polymer material dispersed within the first polymer material, wherein the second polymer material is preferentially removed from the body versus the first polymer material when exposed to energy delivered at a wavelength within the ultraviolet spectrum, visible spectrum or infrared spectrum.

24. The polishing pad of claim 23, wherein the preferential removal of the second material creates an average surface roughness (Ra) in the range of 1-20 microns at a surface of the body.

25. The polishing pad of claim 23, wherein the first polymer material has a smaller absorption rate than the material within the second polymer material at a wavelength found within the delivered energy.

26. The polishing pad of claim 23, wherein the second polymer material is preferentially removed from the body versus the first material when the second polymer material and the first material are both exposed to the energy, wherein the energy has a wavelength within the ultraviolet spectrum, visible spectrum or infrared spectrum.

* * * * *